US005261793A

United States Patent [19]

Piltingsrud

[11] Patent Number: 5,261,793

[45] Date of Patent: Nov. 16, 1993

[54] MINIATURE MECHANICAL VACUUM PUMP

[75] Inventor: Harley V. Piltingsrud, Cincinnati, Ohio

[73] Assignee: The United States of America as represented by the Secretary of the Department of Health and Human Services, Washington, D.C.

[21] Appl. No.: 924,982

[22] Filed: Aug. 5, 1992

[51] Int. Cl.[5] ..... F04B 43/12

[52] U.S. Cl. ..... 417/53; 417/475; 417/477; 417/205

[58] Field of Search ..... 417/477, 475, 372, 205, 417/53

[56] References Cited

U.S. PATENT DOCUMENTS

| | | | |
|---|---|---|---|
| 2,721,270 | 10/1955 | Bennett . | |
| 2,769,912 | 11/1956 | Lupfer et al. . | |
| 2,935,242 | 5/1960 | Lorenz . | |
| 3,055,551 | 9/1962 | Johnson | 417/475 X |
| 3,105,447 | 10/1963 | Ruppert | 417/477 X |
| 3,227,872 | 1/1966 | Nemeth . | |
| 3,385,102 | 5/1968 | Briggs . | |
| 3,649,199 | 3/1972 | Littlejohn . | |
| 3,773,964 | 11/1973 | Brady et al. . | |
| 3,951,570 | 4/1976 | DeBiaggi | 417/475 X |
| 4,039,828 | 8/1977 | Pokar et al. . | |
| 4,090,815 | 5/1978 | Nakamura . | |
| 4,375,346 | 3/1983 | Kraus et al. | 417/205 X |
| 4,459,844 | 7/1984 | Burkhart . | |
| 4,534,204 | 8/1985 | Bergquist . | |
| 4,550,593 | 11/1985 | Reich . | |
| 4,708,604 | 11/1987 | Kidera | 417/477 |
| 4,715,435 | 12/1987 | Foret . | |
| 4,757,198 | 7/1988 | Korte et al. . | |
| 4,797,068 | 1/1989 | Kayakawa et al. . | |
| 4,845,360 | 7/1989 | Landfors . | |
| 4,856,972 | 8/1989 | Van Benschoten et al. | 417/477 |
| 4,865,871 | 9/1989 | Livesey et al. . | |
| 4,954,047 | 9/1990 | Okuyama et al. . | |
| 4,976,590 | 12/1990 | Baldwin | 417/477 X |
| 5,039,280 | 8/1991 | Saulgeot et al. | 417/205 |
| 5,106,270 | 4/1992 | Goettel et al. | 417/372 |

FOREIGN PATENT DOCUMENTS

| | | | |
|---|---|---|---|
| 1089921 | 9/1960 | Fed. Rep. of Germany | 417/372 |
| 57-2489 | 1/1982 | Japan | 417/477 |
| 61-16282 | 1/1986 | Japan | 417/477 |

*Primary Examiner*—Richard E. Gluck
*Attorney, Agent, or Firm*—Lowe, Price, LeBlanc & Becker

[57] ABSTRACT

A miniature mechanical vacuum pump capable of producing intermediate vacuums on the order of about $10^{-1}$ to $10^{-2}$ Torr is provided by a peristaltic pump. In order to dissipate heat in the pump tubing, a cooling fan provides direct a continuously flow of air onto the pump tubing and pump parts contacting the tubing. The pump produces pressures in the range of about $10^{-1}$ to $10^{-2}$ Torr while consuming only about 17 Watts.

18 Claims, 3 Drawing Sheets

MINIATURE MECHANICAL VACUUM PUMP

TECHNICAL FIELD

The present invention relates to vacuum pumps. More particularly, the present invention relates to miniature mechanical vacuum pumps which produce intermediate pressures.

BACKGROUND ART

Heretofore, mechanical rotary vane and piston type pumps capable of producing intermediate pressures (0.01 to 10 Torr) have been used as backing pumps for oil diffusion and turbomolecular pumps as well as roughing pumps for starting ion pumps and cryogenic pumps. These pumps are generally quite heavy, bulky and usually produce oil vapors which can contaminate a vacuum system. Such pumps require relatively large amounts of electrical power.

Presently, the most commonly used backing or roughing pumps are oil-sealed rotary mechanical pumps. The smallest commercially available oil-sealed rotary mechanical pump has a mass of approximately 8 Kg, a volume of approximately 7 liters, and an power requirement of approximately 300 Watts. As indicated above, such pumps are disadvantageous in high vacuum applications because they can inadvertently allow some oil vapor to back-stream into high vacuum pumps and chambers, especially if a power failure should occur. In addition, such pumps are subject to oil leakage during shipment and storage.

Diaphragm pumps have been used as oil-free pumps to produce intermediate pressures down to 1 Torr. By careful selection of pump design, including multiple stages of pumping, one can achieve pressures of less than 20 Torr using very low power consumption (less than 4 Watts), low-mass (less than 0.5 Kg) pumps such as the Brailsford Model TD4X2, (4 pump heads in series, with a 4.5 mm stroke). The lowest pressures obtainable with such a pump design appears to be limited by the minimum pump head dead volume, and the gas pressure required to open the rubber leaf-type pump valves which are utilized.

Portable instrumentations requiring the use of intermediate vacuum pumping have generally relied upon the use of heavy and bulky mechanical pumps including oil-sealed rotary pumps which have the inherent disadvantages noted above.

The present invention relates to a miniature mechanical pump which is an improvement over prior art mechanical pumps.

DISCLOSURE OF THE INVENTION

It is accordingly one object of the present invention to provide a miniature mechanical vacuum pump.

Another object of the present invention is to provide for a light-weight miniature mechanical vacuum pump.

A further object of the present invention is to provide for a miniature mechanical pump which has no dead space and which is capable of pumping vacuums of $10^{-1}$ to $10^{-2}$ Torr.

An even further object of the present invention is to provide for a miniature mechanical vacuum pump which has low power requirements.

A still further object of the present invention is to provide for a miniature mechanical pump which is capable of producing intermediate pressures for various applications.

A still further object of the present invention is to provide for a method of maintaining a vacuum utilizing the miniature mechanical pump of the present invention.

According to these and further objects of the present invention which will become apparent as the description thereof is presented below, the present invention provides a miniature mechanical vacuum pump which includes:

a peristaltic pump assembly having a rotor, including a plurality of rollers, a platen and a compressible length of tubing having a portion thereof positioned between the rotor and the platen; and a fan assembly positioned for directing a continuous flow of air directly onto the rotor, platen and the portion of tubing positioned between the rotor and the platen.

The present invention further provides for an improvement to existing peristaltic pumps which involves a fan assembly positioned for directing a continuous flow of air directly onto the rotor, platen and the portion of compressible tubing which is subjected to compressing during a pumping operation The present invention also provides for a method of maintaining a vacuum within a chamber which involves connecting a suction end of a length of tubing of a peristaltic pump to the chamber, operating the peristaltic pump continuously for a period of time during which period of time the peristaltic pump compresses a portion of the length of tubing, and directing a continuous flow of air directly onto the portion of tubing which is compressed by the rotor, platen and portion of tubing which is compressed by the peristaltic pump.

BRIEF DESCRIPTION OF DRAWINGS

The present invention will be described with reference to the annexed drawings which are given by way of a non-limiting examples only in which.

BEST MODE FOR CARRYING OUT THE INVENTION

The present invention relates to miniature mechanical pumps which are designed to be light weight so as to be particularly suitable for field use. In this regard, the miniature mechanical pumps of the present invention allow field use of equipment which requires intermediate vacuums on the order of about $10^{-1}$ to $10^{-2}$ Torr, including instruments which require vacuum chambers. Alternatively, the miniature mechanical pumps of the present invention may be utilized to provide supplemental intermediate or backing vacuums for systems such as mass spectrometers and the like which may require higher vacuums than can be achieved with the miniature mechanical pumps alone.

Although designed to provide intermediate vacuums for field use, the miniature mechanical pumps of the present invention may also be used in laboratory and industrial settings in conjunction with testing, measurement and monitoring procedures and equipment, and in production procedures and equipment such as those utilized in the manufacturing of semiconductor devices which require intermediate and high vacuums, e.g, thin film sputtering, etching, etc.

The miniature mechanical pump of the present invention is a modified peristaltic pump. According to the present invention, the peristaltic pump is modified so that it can maintain a vacuum of $10^{-1}$ to $10^{-2}$ Torr over an extended period of time. The present inventor determined that the use of a peristaltic pump would provide the advantage of zero dead space and no possibility of oil contamination when used to pump vacuums. Nevertheless, during the course of the present invention it was determined that when pumping to create and maintain vacuums, peristaltic pumps are unable to adequately dissipate heat. In recognizing that the cause of limited tubing life and lower pressure limitations of a peristaltic vacuum pump were due to temperature buildup, the present inventor has designed a solution for the problem, and recognized the potential applications of such a redesigned pump for use with high vacuum pumps. The build up of heat due to friction in the compressed tubing resulted in outgassing of the tubing which limited the lowest pressure the pump could operate at, and shortened the lifetime of the tubing. This problem is not normally encountered in other applications of peristaltic pumps, where the pumped fluid normally carries away heat generated during pumping. The solution involves providing a cooling fan in close proximately to the pump tubing which directs a continuous flow of air onto the pump tubing during pumping.

Figure 1:
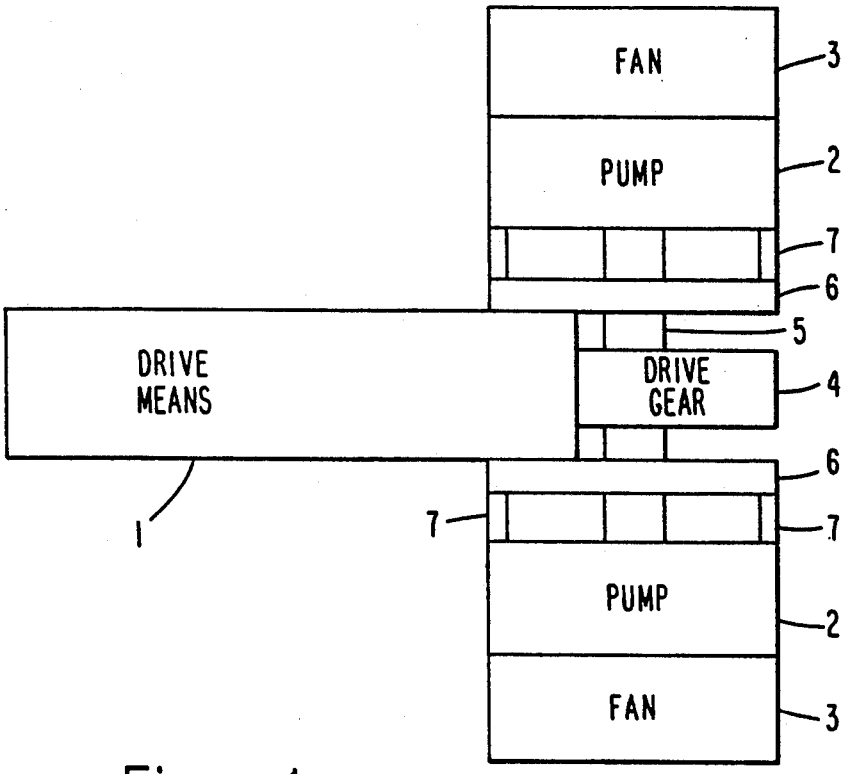
FIG. 1 is a schematic diagram showing a top view of the mechanical pump assembly according to one embodiment of the present invention.

FIG. 1 is a schematic diagram showing a top view of the mechanical pump assembly according to one embodiment of the present invention. As shown in FIG. 1, the pump assembly includes a drive means 1, e.g., an electric motor and one or more peristaltic pump assemblies 2 and a corresponding number of fan assemblies 3.

In the embodiment shown in FIG. 1, the drive means 1 includes a drive gear assembly 4 which allows for two peristaltic pumps 3 to be driven at one time. In this regard, the drive gear assembly 4 transfers rotational motion from the drive means 1 to a single drive shaft 5 which extends from opposite sides of the drive gear assembly 4. In other embodiments, the drive shaft 5 can include two drive shafts each of which extend from an opposite side of the drive gear assembly 4 in a known manner. The drive means 1, drive gear assembly 4 and drive shaft(s) 5 depicted in the figures are conventional, known devices which can be selected and substituted according to other known arrangements as desired. For example, a single drive means could be utilized to drive a single peristaltic pump, if desired. Moreover, more than two peristaltic pumps could be driven by a common drive shaft or equipped with gears to drive any number of secondary drive shafts connected to a number of peristaltic pumps.

The peristaltic pump assemblies 2 can be connected to the drive shaft 5 by conventional means, including a toothed coupler or a drive bearing having a central hole for receiving an end of the drive shaft. Support brackets 6, attached to the drive means 1 are provided to secure the peristaltic pump assemblies 2 in position on the drive shaft 5. In the embodiment depicted in FIG. 1 the peristaltic pump assemblies 2 are attached to support brackets 6 by suitable support posts 7 which, for example, may include stepped bolts or internally threaded cylindrical spacers or cylindrical spacers through which bolts are inserted and attached to the fan assemblies 3.

Fan assemblies 3 are attached to the peristaltic pumps 2 as discussed below.

Figure 2:
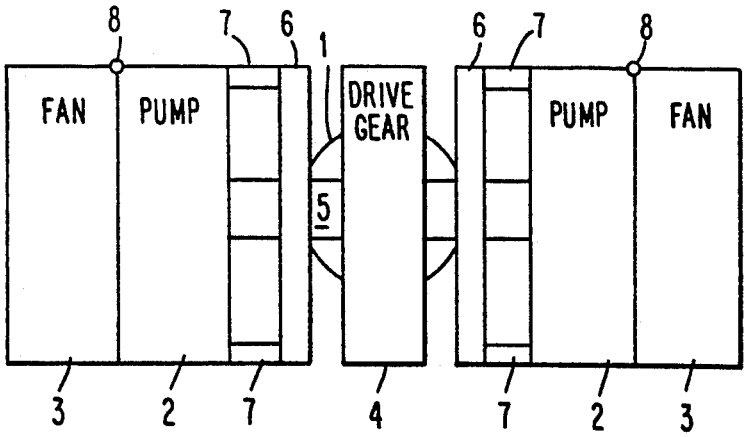
FIG. 2 is a schematic diagram showing an end view of the mechanical pump assembly of FIG. 1.

FIG. 2 is a schematic diagram showing an end view of the mechanical pump assembly of FIG. 1. According to a preferred embodiment, FIG. 2 depicts how the fan assemblies 3 are attached to the peristaltic pump assemblies 2 by a hinge means 8 on one side as shown in FIG. 2. This hinge means 8 includes a receptacle for receiving a hinge pin 23 which is provided on the peristaltic pump assemblies 2 as discussed below.

Figure 3:
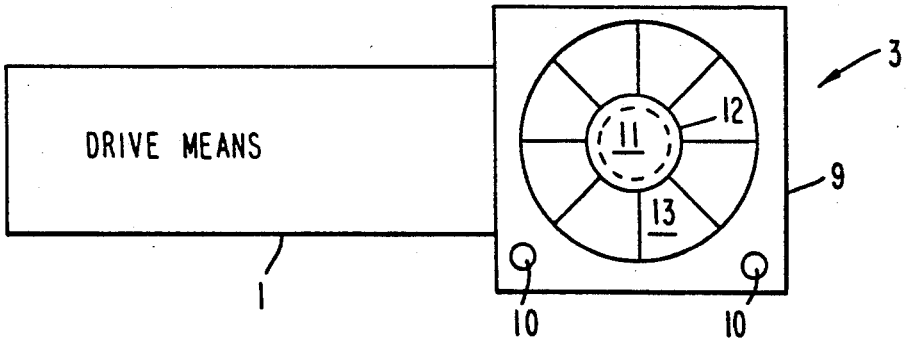
FIG. 3 is a schematic diagram showing a side view of the mechanical pump assembly of FIG. 1.

FIG. 3 is a schematic diagram showing a side view of the mechanical pump assembly of FIG. 1. In FIG. 3, the fan assembly 3 on one side of the pump assembly of the present invention is shown. The fan assembly 3 includes a housing 9 having means to attach the housing 9 to the peristaltic pump assemblies as shown in FIGS. 1 and 2. The means for attaching the fan housing to the peristaltic pump assemblies 2, which has as an integral part of it the platen 16, can include bolts 10 or any equivalent mechanical attachment means, including clips. In a preferred embodiment, the fan assemblies 3 are attached to the peristaltic pump assemblies 2 (cover 18) which is hinged by means 8 on one side as shown in FIG. 2 as discussed above.

Figure 4:
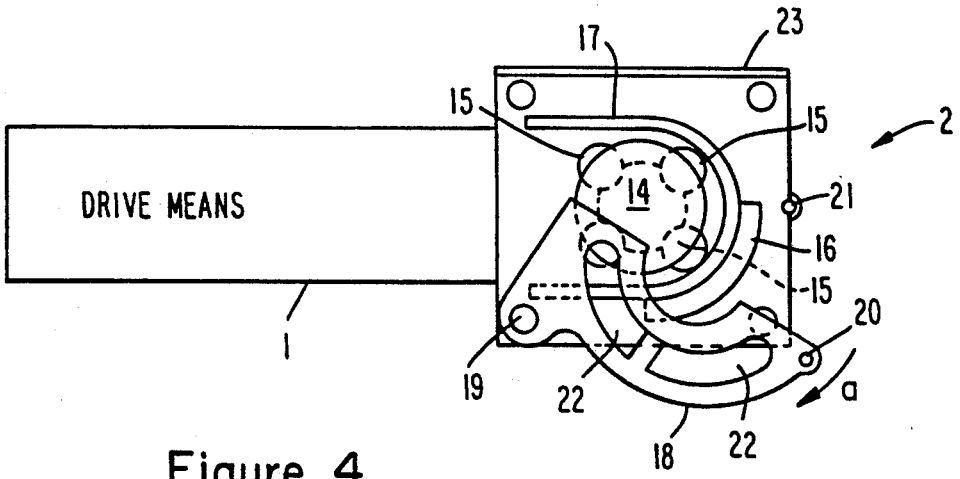
FIG. 4 is a schematic diagram showing a side view of the mechanical pump assembly of FIG. 1, with the fan assembly removed.

Each fan assemble 3 includes an electric motor 11 and a rotor 12 having a number fan blades 13. In a preferred operation, each fan assembly 3 directs a flow of air toward its corresponding peristaltic pump assembly 2. Since it is desirable to cool the tubing 17 of the peristaltic pumps 2 during operation, the diameter of the fan rotor 12 should be large enough to blow air directly on the tubing 17 as it is positioned against platen 16. That is, the radius of the fan blades 13 should preferably be equal to or greater than to the radius of curvature of the platen 16 as shown in FIG. 4. It is noted that the housing 9 of the fan assembly 3 is only a peripheral housing whereby the front (as viewed in FIG. 3) and back of the fan assembly 3 are essentially open so as to provide an unrestricted flow of air onto the peristaltic pump assembly 2 when the fan assembly 3 is operated.

FIG. 4 is a schematic diagram showing a side view of the mechanical pump assembly of FIG. 1, with the fan assembly removed. In FIG. 4, the rotor 14 and rollers 15 of one of the peristaltic pump assemblies 2 are shown together with the platen 16 (an integral part of cover 18) against which the pump tubing 17 is pressed by the rollers 15 when the rotor is 14 rotated.

In order to facilitate changing of the pump tubing 17, the pivotable cover 18 may be provided. This cover 18 protects and holds tubing 17 in position between the rotor 14 and cover 18's inner surface, platen 16, and is pivotal about a pin 19. The cover 18 is held in position by a suitable mechanical fastener, e.g., pin or bolt, which is inserted through holes 20 and 21 when they are aligned. The cover 18, which can be made of a plastic material, includes a number of open slots 22 which allows air to pass therethrough onto the pump tubing 17 and the pump rotor and platen. The cover 18 rotates or pivots in the direction indicated by arrow "a". The peristaltic pump assembly 2 is secured to the support brackets 6 by suitable mechanical means 7 as discussed above. In FIG. 4, a hinge pin 23 is shown to which hinge means 8 is attached. The hinge pin 23 can be supported at either or both ends by short support brackets which are long enough so that the fan assembly 3 is substantially parallel to the peristaltic pump assembly 2 when the fan assembly 3 is in the operable position as shown in FIGS. 1 and 2.

The pump tubing 17 comprises a length of compressible tubing, as is conventional with peristaltic pumps. The tubing material and wall thickness are chosen such that, when containing a vacuum, the tubing will not collapse. When two peristaltic pump assemblies are utilized as shown in FIGS. 1 and 2, the suction end of the pump tubing from each pump assembly may be connected to a tee or "Y" connector which provides a common suction inlet. The pumps may also be used for separate functions such as in a portable instrument where one could back a high vacuum pump, and another pump an interstage of a membrane separator.

Figure 5:
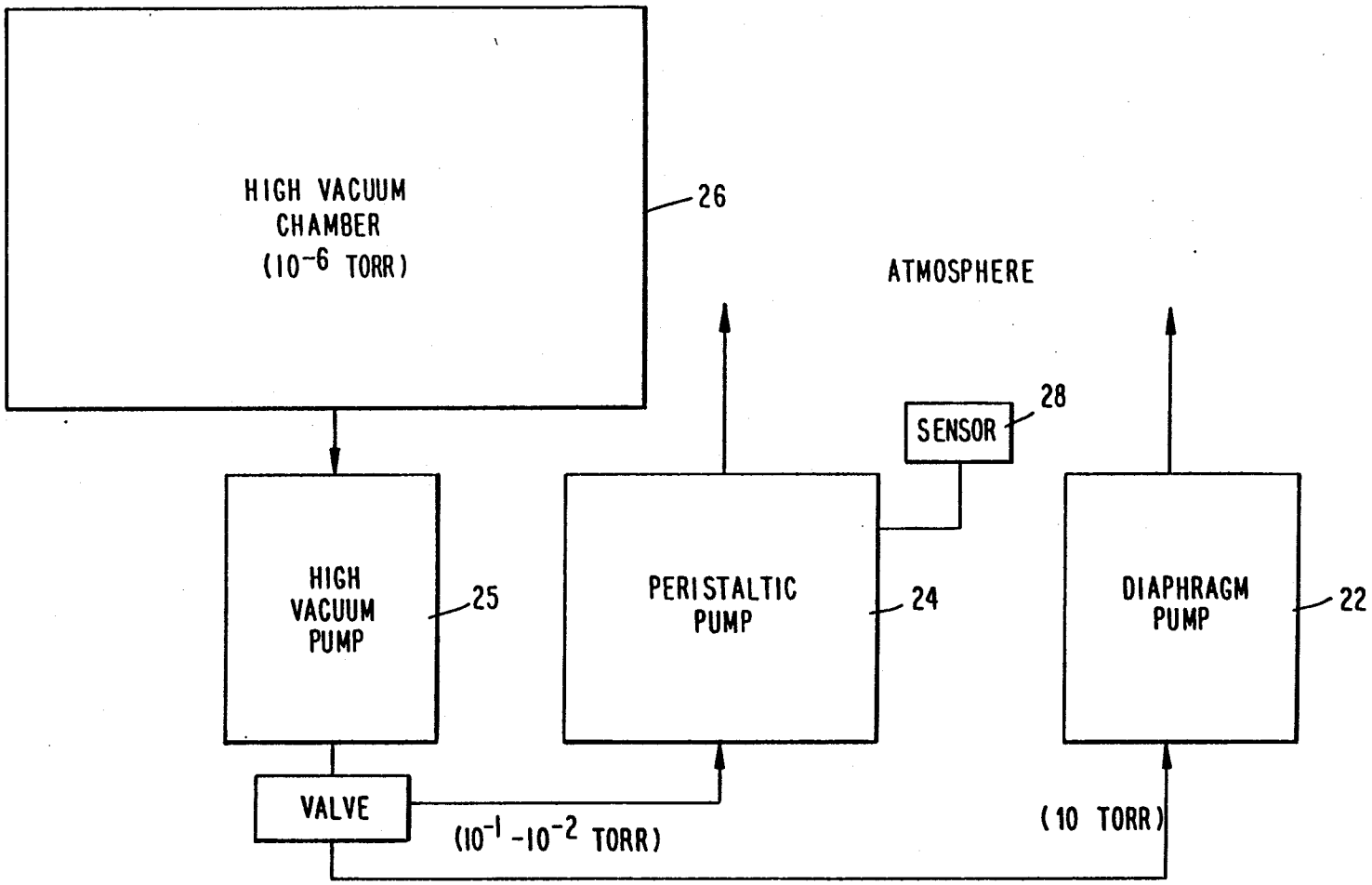
FIG. 5 is a schematic block diagram illustrating an application of a miniature mechanical pump according to the present invention

An example of a typical application of a miniature mechanical vacuum pump is given in FIG. 5. The exemplary application is for a portable mass spectrometer or similar high vacuum instrumentation, where the miniature mechanical pump 24 is used to provide the necessary intermediate pressure ($10^{-1}$–$10^{-2}$ Torr) backing for a high vacuum pump 25, i.e., a turbomolecular pump, an oil diffusion pump, or a molecular drag pump which provides the necessary high vacuum of $<10^{-5}$ Torr for the mass spectrometer vacuum chamber 26. As shown in FIG. 5 an initial roughing pump 27 , e.g., a diaphragm pump can be used to produce initial low pressures, e.g., 10 Torr.

Once a desired vacuum is reached by use of the miniature mechanical pumps of the present invention for a given application, the pump(s) need not operate at full capacity. In many instances, once a desired vacuum is reached, it can be maintained by operating the pump(s) at about one-third or less of its full capacity. Accordingly, in FIG. 5, a pumping requirement sensor 28, e.g., a pressure or flow sensor, is provided to lower the pumping capacity (rpm) after a desired vacuum is reached. This conserves energy, lowers the power requirement of the pump during its use, and extends the pump tubing lifetime.

Features and characteristics of the present invention will be described with reference to the following examples. These examples are given for illustrative purposes only and the present invention is not to be considered as being strictly limited to the embodiments in the Examples.

EXAMPLE 1

In this example, a peristaltic pump was utilized to produce and maintain a vacuum. In this example, no fan assembly was utilized in order to test the operation of the pump without a cooling fan. Since, upon creating a vacuum, no additional fluid would be drawn through the pump, it was anticipated that a certain amount of heat would build-up after a period of time.

In this example a modified Cole-Parmer Masterflex Model L-07021-22 peristaltic pump was operated at 300 RPM, with 4.8 mm I.D. norprene tubing (a specially compounded neoprene tubing manufactured by Norton Co.). When driven by a Merkle-Korff Industries model RF253318-150-34 variable speed D.C. gear motor, this pump has a mass of less than 1.5 Kg and a power consumption of less than 20 Watts. At 300 RPM a base pressure of $3\times10^{-2}$ Torr and a working pressure of $5\times10^{-2}$ Torr with a pumping speed of 0.3 L/min was achieved.

After a period of operation a temperature rise in the tubing was noted, with a temperature of 65° C. reached after 15 minutes of operation. The temperature rise was due to the frictional energy input to the tubing of about 8 Watts, with no heat removal means via a pumped fluid, as is the normal case with peristaltic pumps. Only conduction to the pump housing and rollers allowed heat to escape. The pressure level increased to several Torr as the tubing outgassed from heating. Tubing life was approximately 10 hours.

EXAMPLE 2

In this example, the heating problem of Example 1 was solved by redesigning the pump housing to allow force air cooling over the tubing and the pump roller mechanism during operation. Specifically, a miniature low-power (approximately 4 Watts) cooling fan (Papst Model 812) was used. The cooling fan was attached to the pump assembly as discussed above with references to FIGS. 1–4.

The use of the cooling fan reduced tubing operating temperatures to a few degrees above ambient. Using such a redesigned pump, pumping capacity was maintained at at least 50% after 300 hours of operation. Changing of pump tubing required about 5 minutes and a negligible cost. Total pump power consumption was approximately 17 Watts, including the cooling fan.

Pumping speeds can be increased by increasing the pump RPM, increasing the tubing I.D., or operating multiple tubing sections in parallel as discussed above.

Tubing life can be increased and power consumption reduced in some applications by reducing pumping speed during time periods when reduced pumping requirements exist. An example of this would be with a portable gas chromatograph/mass spectrometer. When sample analysis is not taking place, to reduce helium consumption, helium carrier gas flow may be shut off. Under such circumstances, pumping requirements are greatly reduced. Consequently, the pumping speed of the peristaltic backing pump may be greatly reduced. During the brief period when the helium carrier gas is on, pumping speed would automatically return to full speed.

When evacuating large volumes, a more rapid pumpdown would result from an initial evacuation to approximately 30 Torr using the diaphragm pump discussed above, followed by pumping with the peristaltic pump.

The ability to produce working pressures down to a base pressure of $10^{-2}$ Torr using a small, low-mass, low-cost, low-power-consumption pump is particularly beneficial in the construction of portable scientific instruments, such as portable mass spectrometers.

Desirable pumps for producing the necessary high vacuum for operating mass spectrometers include oil diffusion, ion, turbomolecular, and molecular drag pumps. Oil diffusion pumps typically have maximum exhaust pressures of less than 0.5 Torr. Ion pumps must be started at the lowest possible intermediate pressure (approximately $10^{-2}$ Torr is an acceptable starting pressure for many of these pumps). Turbomolecular pumps vary from $5\times10^{-2}$ to $10^{-1}$ Torr in their maximum exhaust pressure requirements. Molecular drag pumps have maximum exhaust pressure requirements of up to 40 Torr; however, the compression ratio of such pumps may limit the lowest pressures to greater than $10^{-5}$ Torr unless exhaust pressures are less than 1 Torr, and preferably less than 0.1 Torr.

Backing a small (7.5 L/s at $10^{-6}$ Torr) molecular drag pump for use on a portable mass spectrometer would require a pumping speed of 9 mL/min at $5\times10^{-2}$ Torr utilizing a peristaltic pump according to the present invention. Backing a small (75 L/s at $10^{-6}$ Torr) oil diffusion pump would require a pumping speed of 45 mL/min at $10^{-1}$ Torr utilizing a peristaltic pump according to the present invention.

From the above, it can be seen that a small mechanical pump producing pressures down to $10^{-2}$ Torr is well suited to function as a backing or roughing pump for most of the high vacuum pumps typically used.

Although the invention has been described with reference to particular means, materials and embodiments, from the foregoing description, one skilled in the art can easily ascertain the essential characteristics of the present invention and various changes and modifications may be made to adapt the various uses and conditions without departing from the spirit and scope of the present invention as described by the claims which follow.

What is claimed is:

1. A miniature mechanical vacuum pump which comprises:

a peristaltic pump assembly having a rotor, including a plurality of rollers, a platen and a compressible length of tubing having a portion thereof positioned between said rotor and said platen; and a fan assembly positioned for directing a continuous flow of air directly onto said portion of tubing positioned between said rotor and said platen, and onto said rotor and said platen for cooling the same when said peristaltic pump is generating a vacuum.

2. A miniature mechanical vacuum pump according to claim 1, wherein said fan assembly is attached to said peristaltic pump assembly by a hinge means.

3. A miniature mechanical vacuum pump according to claim 1, wherein said peristaltic pump assembly includes a pivotable cover.

4. A miniature mechanical vacuum pump according to claim 1, wherein said miniature mechanical vacuum pump comprises at least two peristaltic pump assemblies and a corresponding number of fan assemblies.

5. A miniature mechanical vacuum pump according to claim 4, wherein said at least two peristaltic pump assemblies comprises two peristaltic pump assemblies and said miniature mechanical vacuum pump further comprises a drive means including a drive gear assembly wherein one each of said two peristaltic pump assemblies is on an opposite side of said drive gear assembly from the other.

6. A miniature mechanical vacuum pump according to claim 5, wherein each one of said two fan assemblies is attached to a separate one of said two peristaltic pump assemblies by a hinge means.

7. A miniature mechanical vacuum pump according to claim 5, wherein each of said two peristaltic pump assemblies includes a pivotable cover.

8. A miniature mechanical vacuum pump according to claim 1 in combination with a high vacuum pump and a separate vacuum chamber wherein said miniature mechanical vacuum pump is connected to an outlet of said high vacuum pump for pumping said high vacuum pump to an intermediate vacuum.

9. A miniature mechanical vacuum pump according to claim 8, wherein said miniature mechanical pump is connected to said high vacuum pump through a valve means.

10. A miniature mechanical vacuum pump according to claim 5 in combination with a high vacuum pump and a separate vacuum chamber wherein at least one of said two peristaltic pump assemblies of said miniature mechanical vacuum pump is connected to an outlet of said high vacuum pump for pumping said high vacuum pump to an intermediate vacuum.

11. A miniature mechanical vacuum pump according to claim 10, wherein at least one of said two peristaltic pump assemblies of said miniature mechanical pump is connected to said high vacuum pump through a valve means.

12. A miniature mechanical vacuum pump according to claim 8, further including a pumping requirement sensor for regulating operation of said miniature mechanical vacuum pump.

13. A method of maintaining a vacuum within a vacuum chamber which comprises connecting a suction end of a length of tubing of a peristaltic pump to said chamber, operating said peristaltic pump continuously for a period of time during which period of time said peristaltic pump compresses a portion of said length of tubing, and directing a continuous flow of air directly onto a rotor and platen of said peristaltic pump and said portion of tubing which is compressed by said peristaltic pump.

14. A method of maintaining a vacuum within a chamber according to claim 15, wherein said continuous flow of air is provided by a fan assembly which is connected to said peristaltic pump.

15. A method of maintaining a vacuum within a chamber according to claim 13, wherein the pressure within said chamber caused by operating said peristaltic pump is between about $10^{-1}$ and $10^{-2}$ Torr.

16. A method of maintaining a vacuum within a vacuum chamber according to claim 13, wherein said vacuum chamber comprises a vacuum chamber of a mass spectrometer.

17. A method of maintaining a vacuum within a chamber according to claim 18, further comprising providing a high vacuum between said vacuum chamber and said peristaltic pump for reducing pressure in said vacuum chamber to a final pressure after said peristaltic pump reduces the pressure in said vacuum chamber to an intermediate pressure.

18. A method of maintaining a vacuum within a chamber according to claim 13, wherein a pumping requirement sensor is provided to regulate operation of said peristaltic pump.

* * * * *